United States Patent [19]

Didek et al.

[11] 4,222,222

[45] Sep. 16, 1980

[54] OPEN-END FRICTIONAL SPINNING APPARATUS

[75] Inventors: Stanislav Didek; Ludvik Fajt; Jaroslav Storek; Jaroslav Slingr; Frantisek Cada; Marie Markova, all of Usti nad Orlici, Czechoslovakia

[73] Assignee: Vyzkumny ustav bavlnarsky, Usti nad Orlici, Czechoslovakia

[21] Appl. No.: 973,025

[22] Filed: Dec. 26, 1978

[30] Foreign Application Priority Data

Dec. 29, 1977 [CS] Czechoslovakia ..... 8987/77

[51] Int. Cl.[3] ..... D01H 1/135

[52] U.S. Cl. ..... 57/58.95; 57/58.89; 57/334

[58] Field of Search ..... 57/58.89–58.95, 57/334, 335

[56] References Cited

U.S. PATENT DOCUMENTS

| | | | |
|---|---|---|---|
| 3,611,695 | 10/1971 | Brown | 57/58.89 |
| 3,786,622 | 1/1974 | Negishi | 57/58.89 |
| 3,913,310 | 10/1975 | Fehrer | 57/58.89 X |
| 3,972,173 | 8/1976 | Fehrer | 57/58.89 |
| 3,981,137 | 9/1976 | Fehrer | 57/58.89 X |
| 4,051,653 | 10/1977 | Mitteregger | 57/58.89 |
| 4,060,966 | 12/1977 | Konig | 57/58.89 |
| 4,107,909 | 8/1978 | Fehrer et al. | 57/58.95 X |
| 4,130,983 | 12/1978 | Dammann et al. | 57/58.95 X |

*Primary Examiner*—John Petrakes

[57] ABSTRACT

There is disclosed an apparatus for the frictional spinning of yarn on the open-end principle. The apparatus includes a mechanism for supplying separated fibers onto one of frictional surfaces provided on respective rotary carriers inserted one in the other and forming a wedge-like gap therebetween in the mouth of which fibers are twisted due to friction with the two frictional surfaces moving in opposite directions in said wedge-like gap, and a mechanism for withdrawing the yarn from said mouth of said wedge-like gap and adapted to prevent any twist propagation, one frictional surface being concave and the other being convex relative to the yarn building region in the mouth of the wedge-like gap. In accordance with the invention a carrier through its front opening situated opposite its second front opening for delivering yarn withdraw from the mouth of the wedge-like gap. The axis of rotation of the outer carrier is perpendicular to the longitudinal axis of an open-end frictional spinning machine, said longitudinal axis constituting a section line along which a horizontal plane and a vertical plane intersect each other and thus divide the machine into four quadrants containing, respectively, a sliver supply container and a yarn take-up mechanism.

3 Claims, 15 Drawing Figures

OPEN-END FRICTIONAL SPINNING APPARATUS

This application is related to co-assigned Didek et al application Ser. No. 882,116, filed Feb. 28, 1978, now U.S. Pat. No. 4,168,601.

The present invention relates to an apparatus for the frictional spinning of yarn based upon the open-end spinning principle, and includes a mechanism for supplying separated fibers onto a frictional surface of a pair of frictional surfaces provided on respective rotary carriers inserted one in the other and associated in a contactless manner with each other so as to form a wedge-like gap in the mouth of which the fibers are twisted due to friction with the two frictional surfaces moving in opposite directions in said wedge-like gap, and a yarn takeoff mechanism for withdrawing the yarn from said mouth of said wedge-like gap, said yarn taking-off mechanism being adapted to prevent any twist propagation, one frictional surface being concave and the other frictional surface being convex relative to the yarn building region in the mouth of the wedge-like gap.

As experimentally ascertained, the structure of the final yarn depends, to some extent, upon the relation between the direction of movement of the fibers being supplied to the yarn building region, in which they wrap into the so-called yarn open end, and the direction of yarn withdrawal from the wedge-like gap.

In the above-described apparatus, fibers are deposited onto the frictional surface in such a way that the direction of fiber supply and that of the yarn withdrawal from the wedge-like gap are opposite to each other. This factor influences the structure of the final product, and particularly as far as the distribution of fibers in the yarn is concerned, so that the yarn exhibits special properties which characterize this yarn type. However, the structure of such yarn is not quite satisfactory with regard to the desired properties, especially strength and evenness.

It is an object of the present invention to provide an apparatus for the frictional spinning of yarn upon the openend spinning principle, which apparatus improve the structure of yarn produced thereon, particularly as far as the yarn strength and evenness are concerned, and simultaneously improves the layout of spinning units located thereon, especially as far as the arrangement of the sliver supply container and the yarn take-up mechanism on the machine is concerned.

To attain this object, an apparatus for the frictional spinning of yarn based upon the open-end spinning principle is provided, which apparatus comprises a mechanism for supplying separated fibers onto a frictional surface of a pair of frictional surfaces provided on respective rotary carriers inserted one in the other and associated in contactless manner with each other so as to form a wedge-like gap in the mouth of which the fibers are twisted due to friction with the two frictional surfaces moving in opposite directions in said wedge-like gap, and a yarn take-off mechanism for withdrawing the yarn from said mouth of said wedge-like gap, said yarn taking-off mechanism being adapted to prevent any twist propagation, one frictional surface being concave and the other frictional surface being convex relative to the yarn building region in the mouth of the wedge-like gap. The present apparatus provides an improvement wherein a fiber supply duct for applying fibers extends into said outer carrier through its first opening situated opposite its second front opening for delivering yarn with-draw from the mouth of the wedge-like gap, the axis of rotation of the outer carrier being perpendicular to the longitudinal axis of an open-end frictional spinning machine equipped with a plurality of frictional spinning units disposed side-by-side, said longitudinal axis constituting a section line along which a horizontal plane and a vertical plane intersect each other and thus divide the machine into four quadrants, a sliver supply container being located in the quadrant in front of said vertical plane and below said horizontal plane while a yarn take-up mechanism is located at least in one of the quadrants behind the vertical plane.

An essential advantage of the apparatus according to the invention consists in that it provides for a favorable position of fibers in the yarn building region from the viewpoint of the yarn forming. The fibers are supplied in a direction oblique to the axis of yarn being built, said direction substantially corresponding to that of the yarn withdrawal.

Due to their specific position, when wrapping onto the yarn open end rotating about the yarn axis, the continuously supplied fibers build a helical formation having a steep lead, in which formation the fibers are already appropriately aligned so that they form a yarn structure which is responsible for desired effective characteristics of the final product, and particularly strength and evenness.

The above-described feature of the invention is also advantageous with regard to the spatial layout of spinning units in the open-end frictional machine, and particularly to the location of the yarn take-up mechanism and the sliver supply container.

With regard to both the construction and operation of the spinning device, the outer carrier is preferably mounted for rotation on supporting rolls.

The specific layout of spinning units in the open-end frictional spinning machine also enables the manufacture of core yarns. For this purpose, a supply package of carrier yarn can be installed in the quadrant above the sliver supply container.

Other advantages of the invention will appear in the following description of a number of preferred embodiments thereof.

Such preferred embodiments of the apparatus according to the present invention will hereinafter be described with reference to the accompanying somewhat schematic drawings which, however, are not intended to limit in any way the scope of the invention to the details included therein. In the drawings:

FIG. 1 is a view of a spinning unit in the operative position, partly in a side view, partly in a sectional view;

FIG. 1*a* is a view similar to FIG. 1 but of the spinning unit modified to produce core yarn;

FIGS. 11–14, inclusive, are views in cross-section of four further embodiments of spinning machines having different arrangements of the sliver supply container and the yarn make-up mechanism.

THE GENERAL ORGANIZATION

Figure 1:
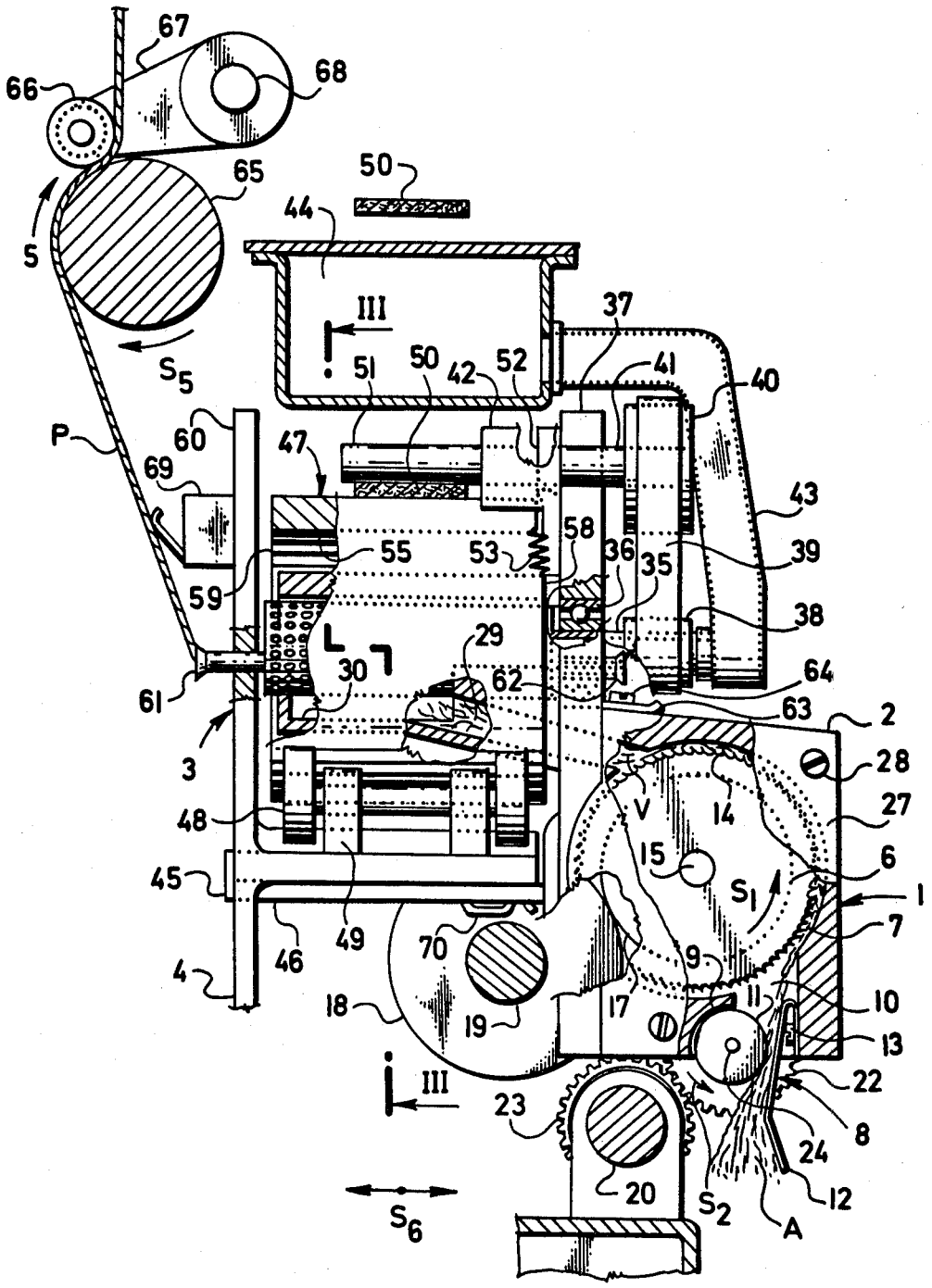
Figure 2:
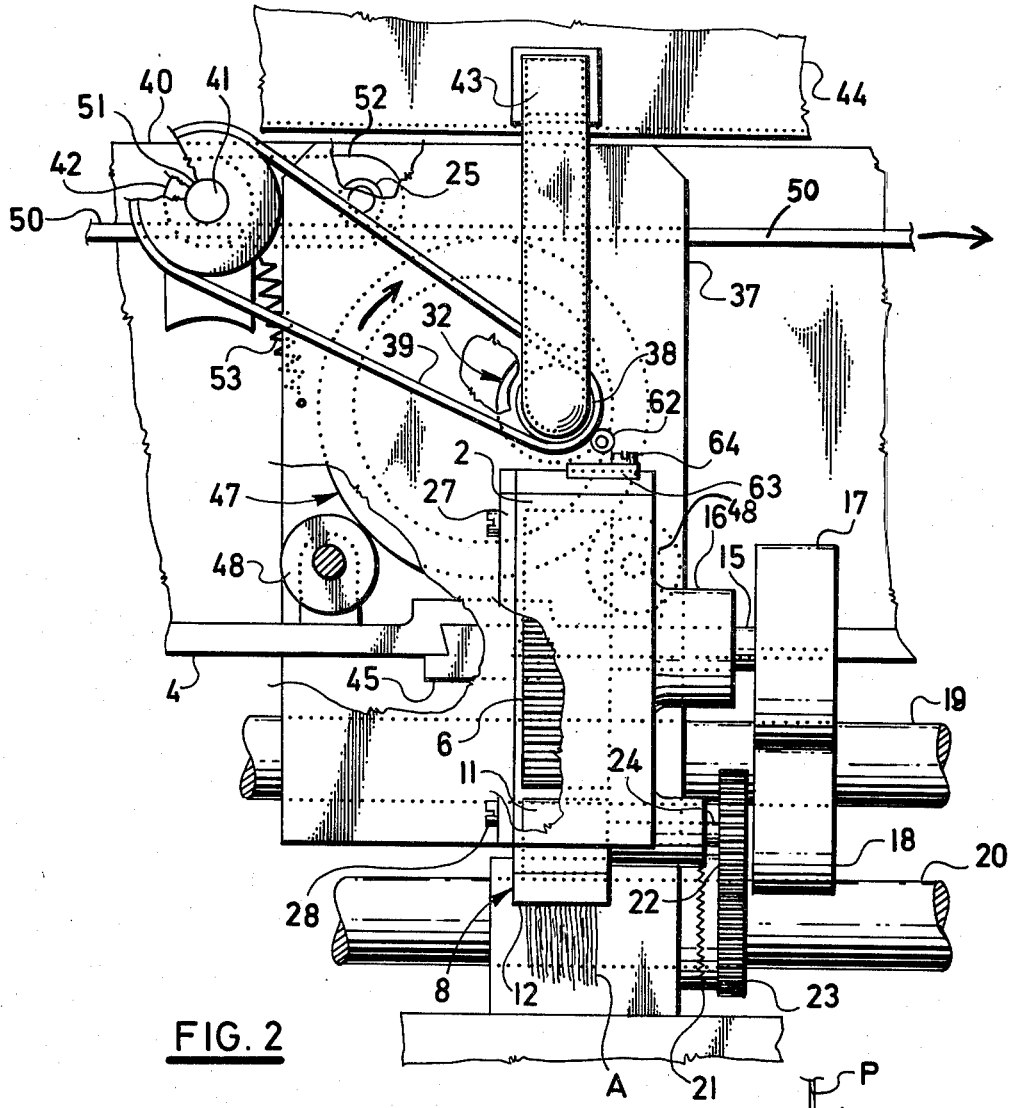
FIG. 2 is a partial rear view of the spinning unit shown in FIG. 1.
Figure 3:
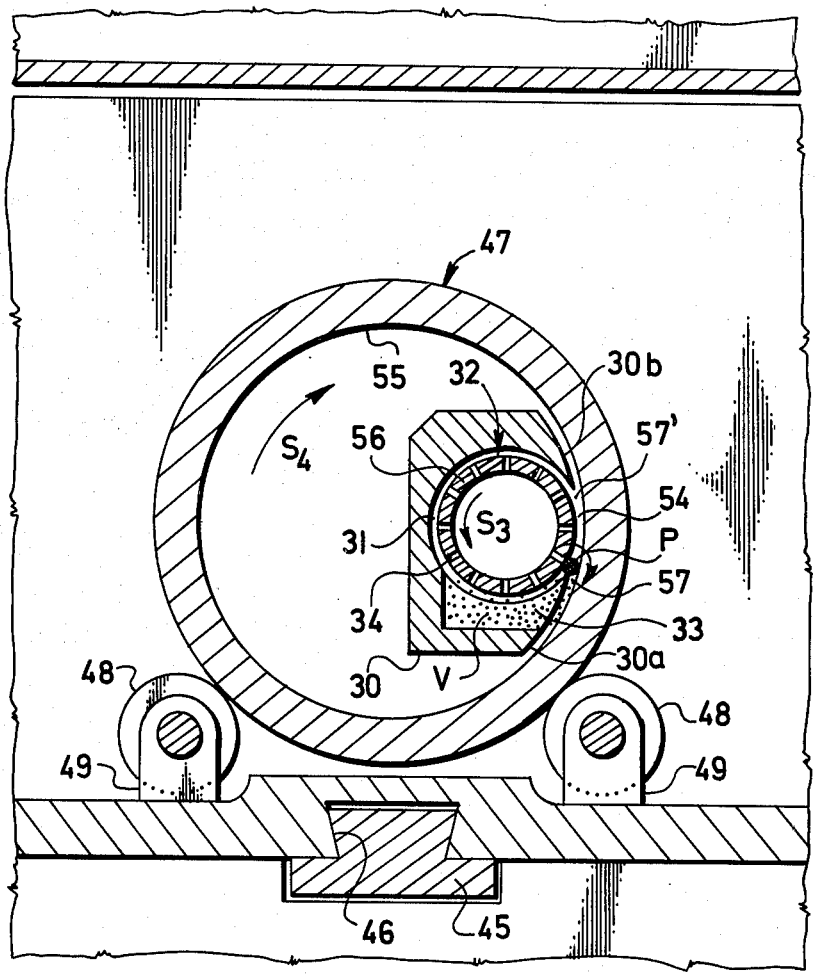
FIG. 3 is a sectional view taken along the broken section line III—III in FIG.1.

As it can be seen in the drawings, and particularly FIGS. 1, 2 and 3 thereof, the spinning unit consists of a fiber separating device 1 received in a housing 2, and of a spinning mechanism proper indicated generally by the reference numeral 3 which is mounted together with the housing 2 on a machine frame 4. Further, the spinning unit comprises a yarn take-off mechanism 5 and a yarn take-up mechanism (not shown ), in which latter yarn is wound to form a cross-wound package.

Operating members of the fiber separating device 1, which latter substantially corresponds to that used with open-end rotor spinning units, are the following: a combing cylinder 6 received in a cylindrical recess 7 provided in the housing 2, and a sliver supply mechanism 8 preceding the combing cylinder 6 and housed in another recess 9 of said housing 2; the two recesses 7 and 9 communicate with each other via a duct 10 (FIG. 1).

The sliver supply mechanism 8 comprises a positively driven feed roller 11 and a presser foot 12 in the form of a leaf spring affixed by a screw 13 to a wall of the housing 2, the free end of presser foot 12 being resiliently forced against said roller 11. The feed roller 11 and the presser foot 12 together produce a nip for a sliver A withdrawn from a sliver supply container (not shown) and supplied to the combing cylinder 6.

The combing cylinder 6, which is provided with combing elements 14, is secured on a shaft 15 mounted for rotation in a hub 16 (FIG. 2) forming an integral part of the housing 2. The shaft 15 is driven via engaging friction wheels 17, 18 from a driving shaft 19 (FIG. 2). Similarly, the shaft 24 of the feed roller 11, which is supported in a bearing (not shown) provided in the housing 2, is driven from driving means (not shown) via a through shaft 20, an electromagnetic clutch 21 and meshing gears 22, 23. The direction of rotation of the combing cylinder 6 and that of the feed roller 11 are denoted by arrows $S_1$ and $S_2$, respectively. The front walls of the housing 2 in which the two recesses 7 and 9 are provided are masked by a cover plate 27 secured to the housing 2, by screws 28 (FIG. 1).

THE SPINNING UNIT

The cylindrical recess 7 of the housing 2 merges into a fiber supply duct 29 which opens into a part-cylindrical chamber 30 (FIGS. 1, 3, 4) fixedly attached to the body of said fiber supply duct 29. In the cavity 31 of the chamber 30, an inner carrier 32 constituted by a hollow perforated cylinder is rotatably mounted with a small clearance. In the drawings, the perforations indicated by 34 are depicted, for the sake of simplicity, at least within the length corresponding to the width of the mouth 33 (FIG. 4) of the fiber supply duct 29. The inner carrier 32 is supported by a hollow shaft 35 rotatably mounted in a bearing 36 arranged in a support wall 37 projecting from the housing 2. The hollow shaft 35 carries a pulley 38 coupled via driving belt 39 with a pulley 40 secured on a shaft 41 rotatable in a bearing body 42 which is also arranged on the support wall 37. One extremity of the hollow shaft 35 communicates with an air conduit 43 connected to a collection pipeline 44 extending along the entire machine and joined to a source of subatmospheric pressure of technological air.

Further, from the housing 2 there projects a support 45 which is mounted on the machine frame 4 by means of a dovetail connection 46 so as to reciprocate on the frame.

Figure 4:
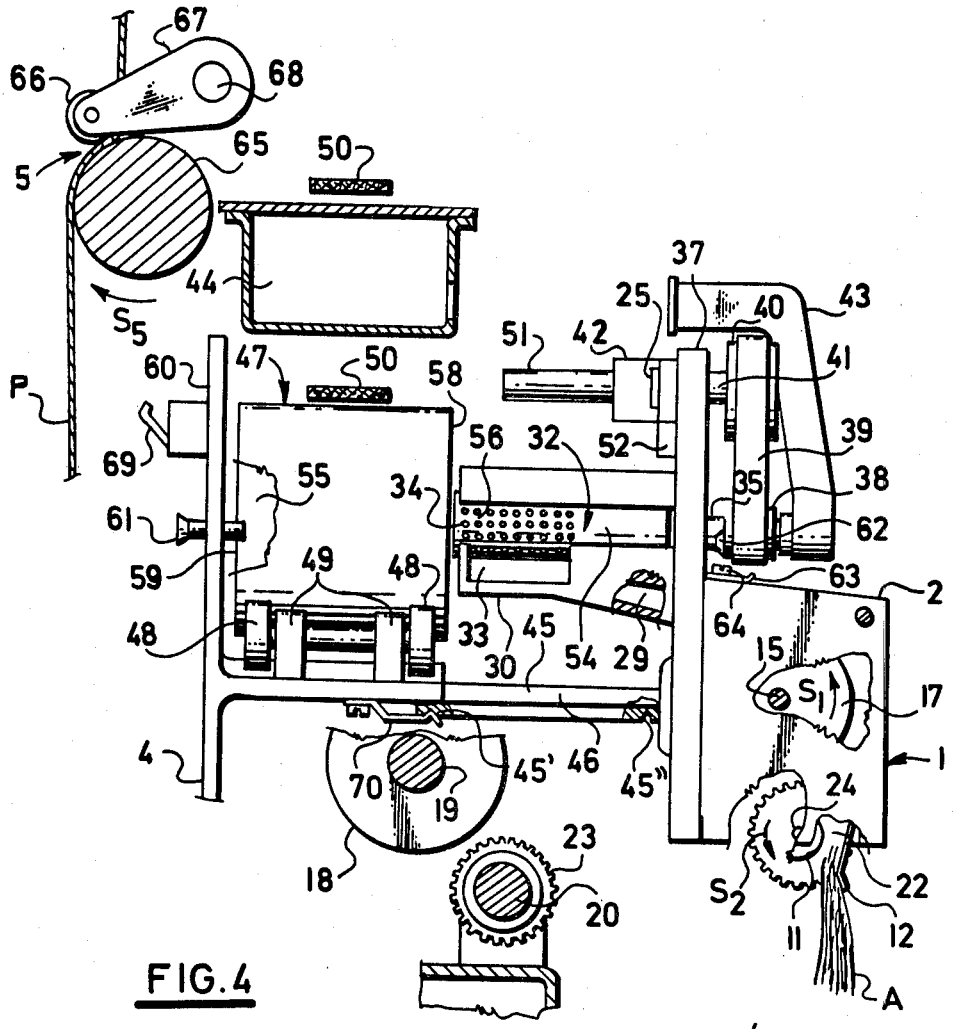
FIG. 4 is a view similar to that in FIG. 1, showing the spinning unit in the inoperative position.

The inner carrier 32 closely but contactlessly confronts the inner wall of an outer carrier 47 which is embodied as a hollow cylinder rotatably supported by a pair of supporting rolls 48 mounted for rotation in brackets 49 which are provided on the machine frame 4 (FIGS. 1, 3 and 4).

As shown in FIGS. 1 and 2, the peripheral surface of the outer carrier 47 is in frictional engagement with a driving belt 50 driven via a gear from an electric motor (not shown). The driving belt 50, which extends along the entire machine and drives the outer carriers 47 of all the spinning units of the machine, is forced into frictional engagement with each of the outer carriers 47 by its respective thrust roll 51 on the shaft 41 (FIG. 2). Roll 51 is rotatably mounted on one end of an arm 52 the other end of which is mounted on a pivot pin 25. The arm 52 is connected with the support wall 37 by means of a spring 53. Thus the means for supporting, locating and driving the outer carrier 47 is formed by the system of supporting rolls 48 and the driving belt 50.

The cylindrical cavity 31 of the chamber 31 merges into an elongated slot 54 (FIGS. 3, 4), a portion of the inner carrier 32 protruding through the slot. The walls 30*a* and 30*b* of the chamber 30 at the lower and upper sides, respectively, of the slot 54 are in contactless confrontation with the inner wall of the outer carrier 47.

The inner wall of the outer carrier 47, which constitutes a first frictional surface 55, is provided, for example, with a vulcanized rubber coating. A second frictional surface 56, on the outer wall of the inner carrier 32, is provided with a smooth coating made, for instance, of a stainless metal.

The two frictional surfaces 55, 56, which rotate in opposite directions as indicated by the respective arrows $S_3$ and $S_4$ (FIG. 3), form at either side of their approach wedge-like lower and upper gaps 57, 57′, respectively, of which the lower gap 57 is designed for forming the yarn P.

In this wedge-like gap 57, the inner frictional surface 56 rotates upwardly toward the apex of said gap while the outer frictional surface 55 moves downwardly away from it; said movements are essential with regard to production of yarn P.

As shown in FIG. 1, the open right hand end 58 of the outer carrier 47 confronts and is spaced from the support wall 37 of the machine, and the open left hand end 59 of the outer carrier 47 confronts and is spaced from a wall 60 which forms an integral part of the machine frame 4.

Aligned with the axis of the yarn P which is formed in the mouth of the wedge-like gap 57 there is provided in the wall 60 a yarn take-off tube 61 providing a duct through which yarn P is withdrawn from said gap 57. In the support wall 37, and more particularly in alignment with the axis of the yarn take-off tube 61, another tube 62 is provided which is designed for effecting the spinning-in process as well as for manufacturing core yarn.

The latter alternative will hereinafter be described in detail.

At the entrance into and somewhat below the tube 62 a gripper 63 formed as a flat spring is secured by a screw 64 to the top wall of the housing 2. The gripper 63 enables the spinning-in process to be performed.

As shown in FIG. 1, yarn P is withdrawn from the mouth of the wedge-like gap 57 through the yarn take-off tube 61 by the yarn take-off mechanism 5 comprising a take-off roller 65 which extends along the entire machine and onto which a thrust roller 66 is forced by means of a spring (not shown), the thrust roller 66 being mounted for rotation on an arm 67 which latter is journalled about a pivot shaft 68 arranged on the machine frame (not thereshown).

The take-off roller 65 is driven in the direction $S_5$; the drive for roller 65 is derived from a driving electric motor (not shown) for the yarn take-off mechanism 5.

There is further provided on the machine frame, between the yarn take-off tube 61 and the yarn take-off mechanism 5, a known thread breakage detector 69 which by known means not shown emits a signal upon thread breakage and, by disabling the feed roller 11 by means of the clutch 21, stops the supply of fibers to the fiber separating device 1 of the spinning unit.

The housing 2, the support wall 37 of which supports the chamber 30, the inner carrier 32, the shaft 41 and the air conduit 43, is mounted by means of the support 45 and the dovetail connection 46 so as to reciprocate in the direction of double-headed arrow $S_6$ on the machine frame 4 between left hand operative position thereof shown in FIG. 1 and an inoperative position to the right shown in FIG. 4; in the latter position the chamber 30 is out of the outer carrier 47, the drive of the combing cylinder 6 and of the feed roller 11 is disconnected, and the air conduit 43 is disengaged from the collecting pipeline 44.

As shown in FIG. 4, the support 45 is held stably in either its right or left hand terminal positions by a spring-loaded lock 70 in the form of a bent leaf spring 70 secured on the lower horizontal branch of the machine frame 4 and received, in the terminal positions of said support 45, in respective arresting grooves 45' and 45'' provided in the bottom part of the support 45.

Figure 1A:
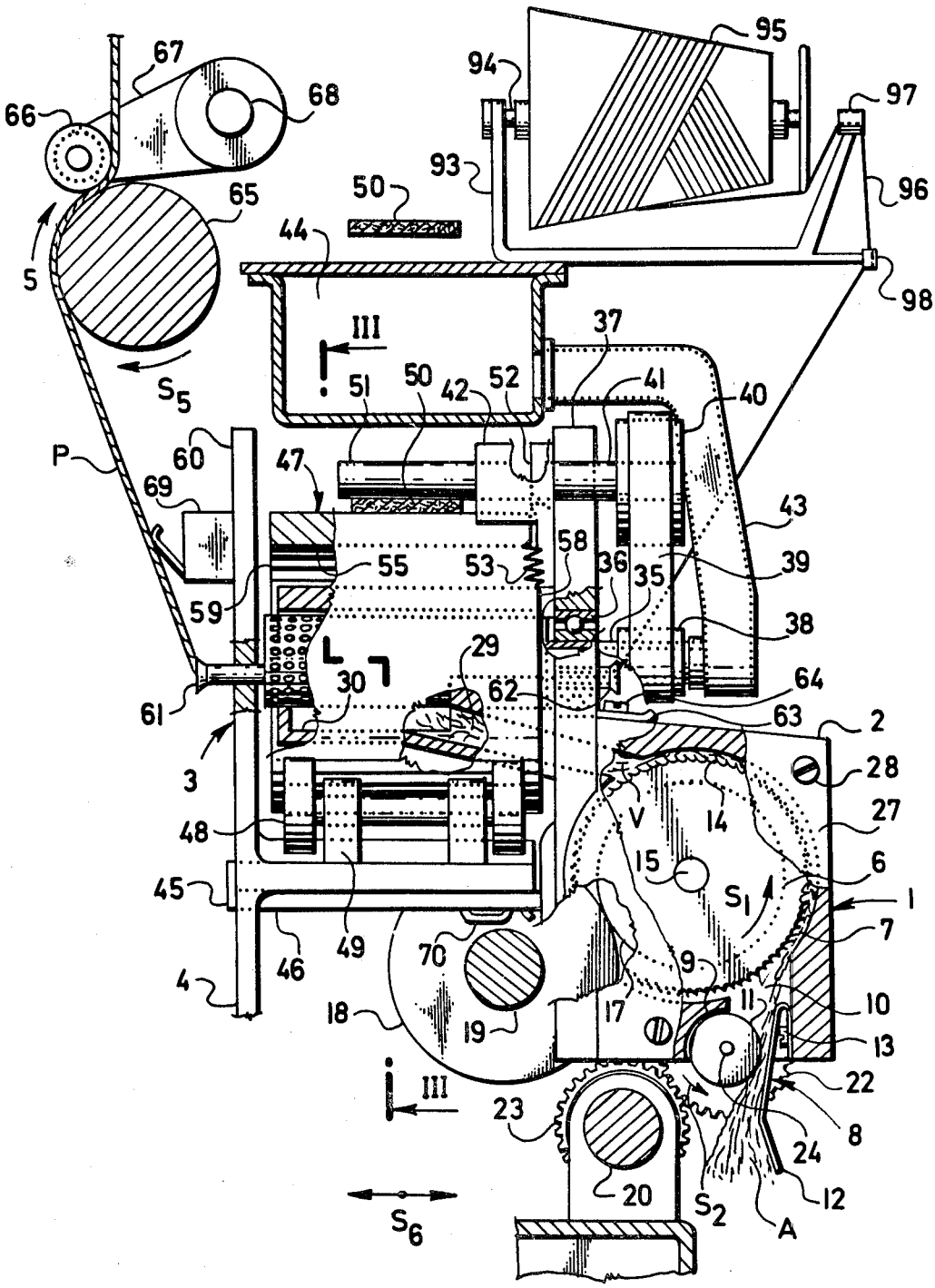

In FIG. 1*a* there is shown a spinning unit similar to that of FIGS. 1–6, inclusive, but modified to produce core yarn. Parts in FIG. 1*a* which are the same as those in FIGS. 1–6, inclusive, are designated by the same reference characters. For this purpose, a bracket 93 secured to the collecting pipeline 44 carries a holder 94 for a supply package 95 with a carrier yarn 96, which holder is provided with thread guides 97 and 98. The carrier yarn 96 can be spun yarn, monofilament, or filament yarn.

The supplied fiber wraps, in a well-known way, onto the carrier yarn 96 in the mouth of the wedge-like gap 57, the final core yarn being withdrawn through the take-off tube 61 and wound onto the take-up package (not shown). THE SPINNING OPERATION The spinning unit operates as follows:

In operation, the housing 2 is in its operative left hand position I (FIG. 1); by sucking air off the cavity of the inner carrier 32, an operating subatmospheric pressure manifests itself via perforations 34 of the inner carrier 32 to exert a sucking effect in the fiber supply duct 29.

Sliver A withdrawn from a sliver supply container (not shown) is led to the nip between the feed roller 11 and the presser foot 12 from which it advances via duct 10 to the combing cylinder 6; the combing elements 14 of the latter comb individual fibers V (FIG. 4) from the so-called fiber beard, the fibers being carried along with the surface of said cylinder 6 toward the entrance of the fiber supply duct 29. Due to centrifugal force, fibers in this region are hurled off the combing cylinder 6 and further on, due to their inertia force and the action of operating subatmospheric pressure, are conveyed in straight condition through the fiber supply duct 29 onto the perforated frictional surface 56 of the inner carrier 32. The technological air flow sucked in through the perforations 34 of the inner carrier 32 holds the fibers on the frictional surface 56 which entrains them into the wedge-like gap 57 where they accumulate in parallel orientation and continuously wrap onto the open end of yarn P, which is twisted by rolling on the frictional surfaces 55 and 56. The final yarn product is withdrawn by the take-off mechanism 5 and wound in a take-up mechanism (not shown) to form a package.

An essential feature of the spinning unit of the invention is in that the fiber supply duct 29 enters the outer carrier 47 through its first end opening 58 while yarn P is withdrawn from the mouth of the wedge-like gap 57 through the opposite second end opening 59 of said carrier 47.

Figure 5:
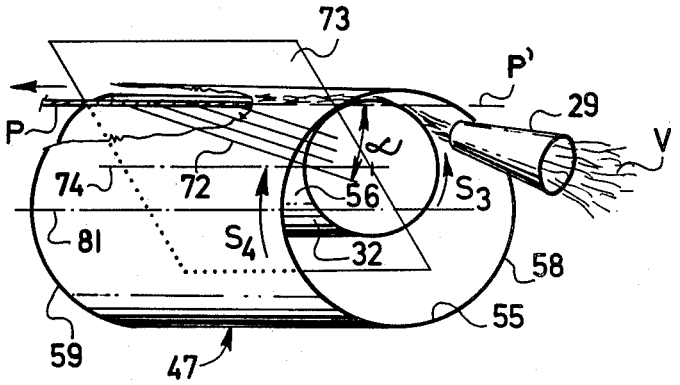
FIG. 5 is a perspective view of the inner and the outer carrier.

As shown in FIG. 5, the geometrical projection of the trajectory of each fiber on its way toward the frictional surface 56 of the inner carrier 32, onto a radial plane 73 passing through axis 74 of the inner carrier 32 and through axis P' of the yarn P being built, forms an angle alpha ($\alpha$) ranging from 0° to an acute angle with the trajectory of said yarn P, the directions of said two trajectories corresponding to each other and extending from the edge of the first opening 58 of the outer carrier 47 to the edge of the opposite second opening 59 thereof.

Figure 6:
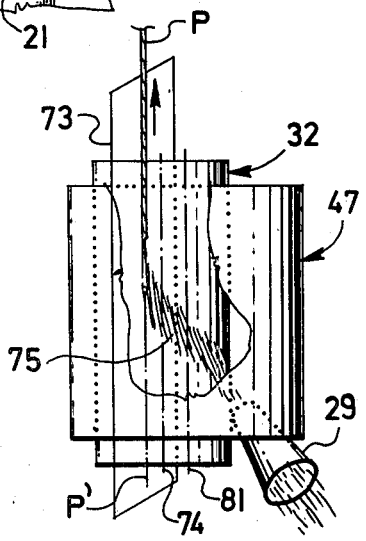
FIG. 6 is a top view of the two carriers shown in FIG. 5.

The fibers wrap into the open end of yarn P in the region 75 of the inner carrier 32 in the region of the wedge-like gap 57, as shown in FIG. 6.

THE SPINNING-IN OPERATION

In a simultaneous spinning-in process, all the rotary elements of the machine are out of operation before the machine has been set in operation again, which means that the fiber separating device 1, the carriers 32, 47, the yarn take-off mechanism 5 and the yarn take-up mechanism are disconnected, e.g. by means of disconnecting coupling elements, from their respective driving means. However, the technological air is constantly sucked off the spinning units.

The attendant displaces the housing 2 from its left hand operative position of FIG. 1 to its right hand, inoperative one in which latter the chamber 30 is out of the outer carrier 47. Simultaneously, the end portion of the air conduit 43 is disconnected from the collecting pipeline 44 so that sucking effect in the chamber 30 becomes null. Then the attendant cleans the two frictional surfaces 55, 56 from fiber remainders and puts the housing 2 back in its left hand, operative position. Thereupon he draws a drawing-in hook through the tube 62, the wedge-like gap 57 and the yarn take-off tube 61 and puts therein the yarn end unwound from the package; after pulling the hook back out of the tube 62, the attendant clamps said end in the gripper 63 and simultaneously leads the yarn between the take-off roller 65 and the thrust roller 66.

Owing to the displacement of the housing 2 into its operative position, air is sucked in again through the perforation 34 of the inner carrier 32 from the fiber separating device 1 via fiber supply duct 29. After the combing cylinder 6 has been set in rotation, the carriers 32, 47, the yarn take-off mechanism 5 and the yarn take-up mechanism are started, either simultaneously, or after a program-controlled delay. Due to the operation of the yarn take-off mechanism 5, the tension of yarn clamped in the gripper 63 rises, and the thread breakage detector 69 sets the feed roller 11 in motion so that the separated fibrous material is conveyed again, in the afore-described manner, into the mouth of the wedge-like gap 57. In the meantime, the yarn, due to its tension, disengages itself from the gripper 63 and advances between the frictional surfaces 55, 56 while simultaneously rolling thereupon in the direction to the yarn take-off tube 61. Simultaneously, fresh fibers wrap onto the yarn end and due to the open end rotation, form the yarn which is finally withdrawn by the yarn take-off mechanism 5.

In case of a single thread breakage, the spinning-in process corresponds, at least at the beginning, to that above-described, except that the package is disengaged from the driving roll of the yarn take-up mechanism and the yarn is not introduced between the rollers 65 and 66. After the combing cylinder 6 has been set in motion, the attendant simultaneously tilts the package against the driving roll of the take-up mechanism and introduces the yarn between the rollers 65 and 66; in this way, the fiber supply into the spinning unit is restored in response to an impulse of the thread breakage detector 69.

ALTERNATIVE ARRANGEMENTS OF THE MACHINE

Figure 7:
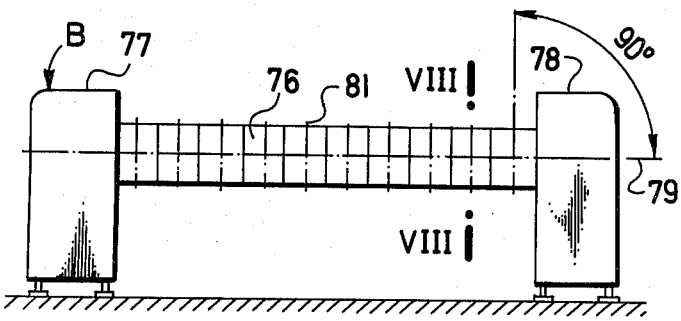
FIG. 7 is a front view of the spinning machine equipped with the spinning units.
Figure 8:
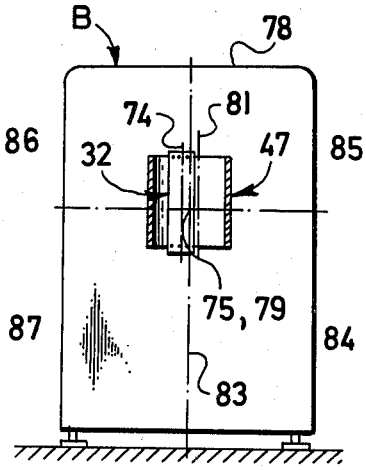
FIG. 8 is a sectional view taken along the line VIII—VIII in FIG. 7.

Spinning units 76 each corresponding to the spinning unit shown in FIGS. 1–6, inclusive, are shown in the embodiment of FIGS. 7 and 8 as blocks arranged side-by-side between two end enclosures 77 and 78. Units 76 form the open-end frictional spinning machine generally designated B. Elements and gears for driving operational members of the spinning units are located in the end enclosures.

As hereinabove set forth, the fiber supply duct 29 for supplying fibers onto the frictional surface of the inner carrier 32 enters the outer carrier 47 through the first opening 58, which is situated opposite the second opening 59 from which the yarn P is withdrawn.

The merit of the afore-mentioned feature resides in the possibility of an advantageous location of the yarn take-up mechanism and sliver supply containers A of the spinning units 76.

In the open-end frictional spinning machine B (FIGS. 7 and 8) there can be defined an axis 79 passing through the mouths of the wedge-like gaps 57 of the spinning units 76 in the regions 75 (FIG. 6), the axis 79 being perpendicular to the axes of rotation 81 of the outer carriers 47. The longitudinal axis 79 constitutes a section line of two planes intersecting each other, viz. horizontal plane 82 and vertical plane 83 which define four quadrants 84 to 87 shown in FIG. 8 in which a sectional view along the line VIII–VIII in FIG. 7 is illustrated.

When the sliver supply container is located in any of the lower quadrants 84 or 87, the yarn take-up mechanism can be installed in one of the upper quadrants 85 or 86, or, respectively, between the quadrants 84 and 85, or 86 and 87. The spinning unit is shown as a sectional view of the two carriers 32 and 47. In this case, the axes of rotation 81 of the outer carriers 47 are vertical (FIGS. 7 and 8).

Figure 9:
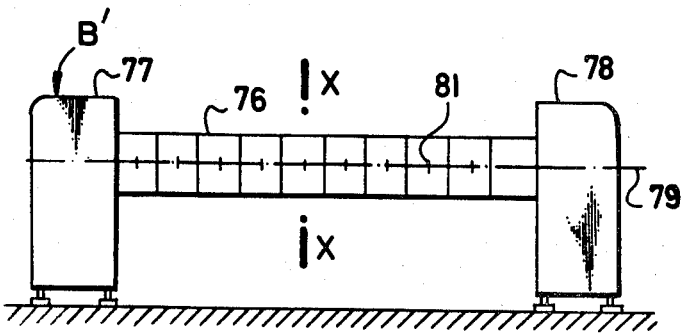
FIG. 9 is a view similar to that in FIG. 7, showing an alternative embodiment of the machine.
Figure 10:
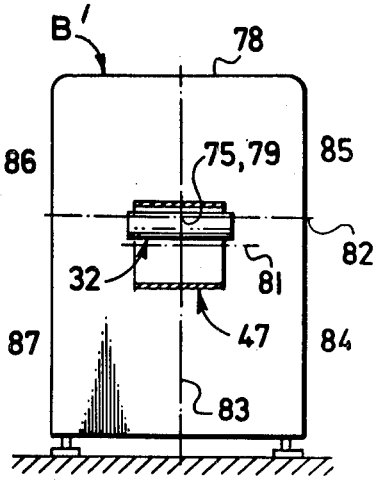
FIG. 10 is a sectional view taken along the line X—X in FIG. 9.

In FIGS. 9 and 10, there is shown a spinning machine $B^{i}$ having an alternative arrangement of spinning units; the axes of rotation 81 of the outer carriers 47 are horizontal in this embodiment.

Figure 11:
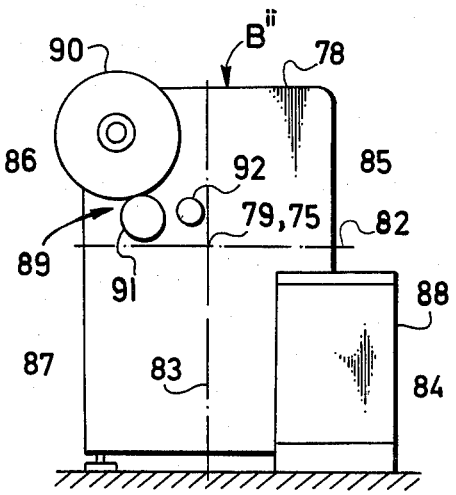

In the machine $B^{ii}$ of FIG. 11, the sliver supply containers 88 are located in the quadrant 84 and the yarn take-up mechanism 89 is in the quadrant 86. Machine $B^{ii}$ is shown as comprising a package 90, a driving drum 91 and a traversing yarn guide 92.

Figure 12:
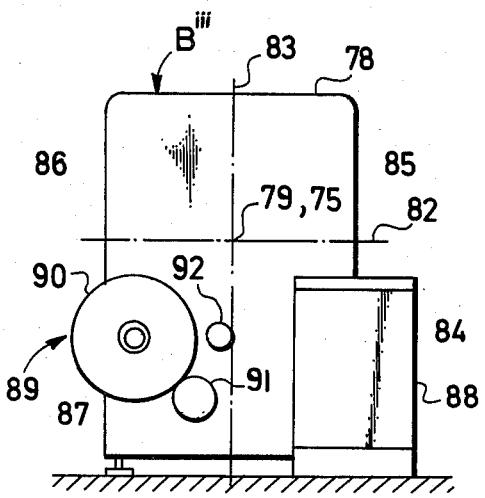

Another machine arrangement $B^{iii}$ is shown in FIG. 12; in such machine the sliver supply container 88 is located in the quadrant 84 and the yarn take-up mechanism 89 in the quadrant 87.

Figure 13:
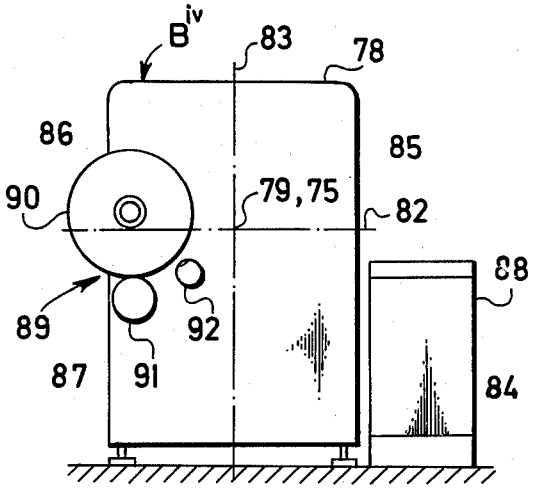

In the machine $B^{iv}$ in FIG. 13, the sliver supply container 88 is located in the quadrant 84 in front of the machine B, and the yarn take-up mechanism 89 between the quadrants 86 and 87.

Figure 14:
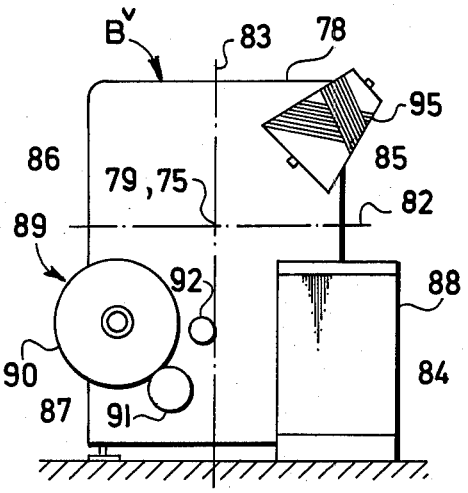

In the machine $B^{v}$ shown in FIG. 14, the arrangement is generally the same as that depicted in FIG. 12, but the supply package 95 is located in the quadrant 85.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a spinning machine having a plurality of units for frictional spinning of yarn based upon the open-end spinning principle, each unit including a mechanism for supplying separated fibers onto a frictional surface of a pair of frictional surfaces provided on respective rotary carriers, a first one of said carriers being an inner carrier, a second of said carriers being an outer carrier, the first carrier being inserted in the second carrier, the two carriers being associated in contactless manner with each other so as to form a wedge-like gap in the mouth of which the fibers are twisted due to friction with the two frictional surfaces moving in opposite directions in said wedge-like gap, and a yarn take-off mechanism for withdrawing the yarn from said mouth of said wedge-like gap, said yarn take-off mechanism being adapted to prevent any twist propagation, one frictional surface being concave and the other frictional surface being convex relative to the yarn building region in the mouth of the wedge-like gap, the improvement wherein each unit has a first fiber supply duct for supplying fibers, the first duct extending into said outer carrier, and a second duct situated opposite the first duct for delivering yarn withdrawn from the mouth of the wedge-like gap, the spinning machine having the open-end spinning units disposed side-by-side, the axis of rotation of the outer carrier of each unit being perpendicular to the longitudinal axis of the spinning machine, said longitudinal axis constituting a section line along which a horizontal plane and a vertical plane intersect each other and thus divide the machine into four quadrants, a sliver supply container being located in the quadrant in front of said vertical plane and below said horizontal plane, a yarn take-up mechanism being located at least in one of the quadrants behind the vertical plane.

2. An apparatus as claimed in claim 1, wherein a supply package with a carrier yarn is located in the quadrant above the sliver supply container.

3. An apparatus as claimed in claim 1, comprising supporting rollers mounting the outer carrier for rotation.

* * * * *